US005895018A

United States Patent [19]

Rielo

[11] Patent Number: 5,895,018

[45] Date of Patent: Apr. 20, 1999

[54] MAGNETIC SUPPORT ATTACHMENT

[76] Inventor: Ricardo G. Rielo, P.O. Box 6395, Denver, Colo. 80206

[21] Appl. No.: 08/855,677

[22] Filed: May 14, 1997

[51] Int. Cl.[6] ..... A47G 1/17

[52] U.S. Cl. ..... 248/206.5; 248/309.4

[58] Field of Search ..... 248/206.5, 309.4, 248/467, 683, 684, 686; 24/66.1, 303, 706.4, 707.4, 707.6, 709.7; 340/572; 411/84, 85, 338, 339, 457, 508, 509, 908

[56] References Cited

U.S. PATENT DOCUMENTS

| | | | |
|---|---|---|---|
| 2,557,398 | 6/1951 | Teetor | 248/467 |
| 2,557,399 | 6/1951 | Teetor | 248/467 |
| 2,641,793 | 6/1953 | Wilm . | |
| 2,965,978 | 12/1960 | Olson | 24/303 |
| 2,967,038 | 1/1961 | Lennemann . | |
| 3,107,361 | 10/1963 | Glutting, Sr. . | |
| 3,350,045 | 10/1967 | Mayers . | |
| 3,365,684 | 1/1968 | Stemke et al. . | |
| 3,529,328 | 9/1970 | Davison | 24/303 |
| 4,000,543 | 1/1977 | Paskert | 340/572 |
| 4,039,082 | 8/1977 | Ladinsky . | |
| 4,104,622 | 8/1978 | Van Niel | 340/572 |
| 4,525,115 | 6/1985 | Garner, Sr. | 411/457 |
| 4,609,173 | 9/1986 | Belokin . | |
| 4,866,426 | 9/1989 | Evan et al. | 340/572 |
| 5,019,801 | 5/1991 | Anderson, III | 340/572 |
| 5,067,618 | 11/1991 | Johnson . | |
| 5,682,653 | 11/1997 | Berglof et al. | 24/303 |

*Primary Examiner*—Leslie A. Braun
*Assistant Examiner*—Robert Lipcsik
*Attorney, Agent, or Firm*—Ramon L. Pizarro; Edwin H. Crabtree

[57] ABSTRACT

A support system for magnetically supporting a thin, pliable section of material, such as a kitchen towel from a surface. The support system includes a first plate with an upper surface and a lower surface and a second plate with an upper surface and a lower surface. The section of material along with at least one magnet is placed between the lower surface of the first plate and the upper surface of the second plate. A fastening device for attaching through the thin pliable material and attaching the first plate to the second plate, is included through the entire assembly, so that the thin pliable material is retained between the lower surface of said first plate and said upper surface of said second plate.

11 Claims, 4 Drawing Sheets

MAGNETIC SUPPORT ATTACHMENT

BACKGROUND OF THE INVENTION (a) Field of the Invention

This invention generally relates to a device for supporting a cloth or the like from a surface by means of a magnet, and more specifically, but not by way of limitation, to an attachment for cloth articles for supporting the cloth articles by means of a magnet.

(b) Discussion of Known Art

The need for hanging or supporting articles such as kitchen towels and the like has been long felt. Particularly, there exists a long felt need to support articles made from a pliable material. Accordingly many devices have been formulated to meet this need. For example, in U.S. Pat. No. 5,067,618 to Johnson teaches a device that includes a magnet to support a plate member with means for hanging articles. Perhaps one of the most salient disadvantages of the Johnson invention is that it is designed for positioning of the device at a specific location, and then the user must move over to the mounting location in order to use the device.

Another device for hanging articles is taught in U.S. Pat. No. 4,609,173 to Belokin, which teaches a towel hanger with magnetic supports. The Belokin device approaches the problem of supporting towels at a desired location by providing a structure that substitutes the need for the well known towel rack or rod. The Belokin device is disadvantaged, therefore, in that it requires that the user first locate the location where the device is mounted, and then hang the towel from the rod member of the device.

Yet another known device is taught in U.S. Pat. No. 4,039,082 to Ladinsky. The Ladinsky device, like the Johnson device and the Belokin device, includes a structure that forms a platform from which articles are hung. Thus, the Ladinsky device suffers from disadvantages akin to the disadvantages of the Johnson and Belokin devices in that the user must move to and from the support device every time the user wishes to use one of the articles supported by the device.

Yet another known device includes U.S. Pat. No. 3,365,684 to Stemke et al. The Stemke device is a system for retaining a shower curtain at desired locations within a shower. The Stemke device includes a plurality of supports that are attachable through the shower curtain to attach a magnet to the shower curtain. The Stemke device is disadvantaged however, in that it allows support of the shower curtain from a single side. Thus the user must ensure that the magnetic side of the attachment is placed on the side from which the curtain is to be supported.

Other known devices include U.S. Pat. No. 3,350,045 to Mayers, which teaches an article holder that can include magnetic supports for a one piece gripping member which can be used to hold sheets of material, such as pictures and the like. The structure of the Mayers device offers advantages in supporting articles that have a long, straight edge, but is not particularly well suited for supporting articles that are very supple, such as a towel or rag.

Still another known device is found in U.S. Pat. No. 3,107,361 to Glutting, Sr., which discloses yet another system for supporting a shower curtain at a desired location. The Glutting device is particularly well suited for supporting a shower curtain. However, the Glutting device does not lend itself to the support of individual towels, rags, and the like.

Yet another known device is disclosed in U.S. Pat. No. 2,967,038 to Lennemann. The Lennemann patent discusses several embodiments that mount on one side of an article to be supported from a ferrous surface. Perhaps the greatest shortcoming of the Lennemann device is that it is designed for attachment to one side of the device to be supported by the invention. This arrangement permits optimal use of the support magnet to support a sheet of material or the like from only one side of the sheet of material. This shortcoming greatly reduces the convenience of use of the any of the embodiments discussed in the Lennemann patent with articles such as kitchen towels and the like.

It has been discovered that to conveniently support a flexible sheet of material, such as a kitchen towel or the like, it would be advantageous to provide a device that allows the user to support the flexible sheet without having to look at the flexible sheet to ensure that the correct side of the sheet is being placed against the ferrous surface. In other words, the device should allow the user to affix the device to a ferrous surface without having to search the flexible sheet to determine whether the correct side of the flexible sheet is being used to place the support against the ferrous surface.

U.S. Pat. No. 2,641,793 to Wilm teaches a pot holder with a magnet nested within the fibrous fill and between two sheets of fabric used to hold the magnet and fibrous fill together. While the Wilm device recognizes the important benefits of having a magnetic device to support a pot holder, namely the benefit of not requiring the user look for and manipulate a hook to support the pot holder, the structure taught by the Wilm suffers from important disadvantages. One disadvantage of the Wilm device is that by nesting the magnet in the fibrous material one produces a device that will favor one side of the pot holder versus the other. More specifically; by nesting the magnet within the fibrous padding one places a layer of fibrous padding, as well as a layer of fabric, between the magnet and the ferrous material to which the magnet is to cling. This layer of fibrous padding will seriously compromise the amount of strength of the magnetic field available for support of the pot holder. Thus, the structure of the Wilm device will favor support against one side of pot holder versus the other, producing problems that are similar to the problems encountered with the Lennemann invention.

Still another disadvantage of the Wilm structure is that it can only be used with a device such as a pot holder, where sections of fabric are used to define a pocket for holding the magnet. Thus, this kind of structure does not lend itself to supporting single sheets of fabric or other thin, flexible sections of material.

It is clear that there remains a need for a magnetic support that can hold flexible laminar articles, such as kitchen towels, curtains, screens and the like.

SUMMARY

It has been discovered that the problems left unanswered by known art can be solved by providing clip or attachment that mounts on a section of pliable material, the attachment includes at least the following components:

a) at least one magnet having a perimeter and a thickness;

b) a first plate with an upper surface and a lower surface;

c) a second plate with an upper surface and a lower surface; and d) an attachment element for attaching through the pliable material and attaching the first plate to the second plate, so that the thin pliable material is sandwiched between the lower surface of the first plate and between the magnet and the upper surface of the second plate.

Clearly, it is contemplated that the instant invention may be used with a pair of magnets, each magnet being mounted against one of the plates. With this variation, the instant invention may be mounted on a section of pliable material by placing the magnets on either side of the pliable material and retaining the magnets by means of the plates and attachment means.

It has been discovered that this structure solves the problems left unanswered by the prior art. Importantly, it has been discovered that the above structure allows the use of a thin first plate which minimizes the amount of material between the magnet and the ferrous structure from which the pliable material is to be supported. Moreover, the thickness of the second plate can be reduced to minimize the distance between the magnet and the ferrous structure. Thus, by minimizing the amount of material to be placed on either side of the magnet one produces a magnetic support system that allows the user to effectively attach the pliable section of material from a ferrous or magnetic surface from either side of the section of material.

In a highly preferred embodiment of the invention the first plate includes an aperture which is larger than the perimeter of the magnet. The aperture in the first plate may extend through the entire thickness of the plate. The aperture in the first plate allows the pliable material to be placed between the first plate and the magnet, with the pliable material being pinched between the magnet and the aperture in the first plate. This aperture allows minimization of the amount of material between the magnet and the ferrous support surface, while providing enough structure to support means for attaching the first plate to the second plate.

Another important feature of a highly preferred embodiment is that the second plate also includes an aperture which has been adapted for receiving the perimeter of the magnet. This aperture in the second plate, however, should be of a depth that is less than the thickness of the magnet. Clearly, the aperture could extend through the second plate, but if the aperture extends through the aperture an additional element, such as a protrusion, fastener, ridge or, taper in the aperture, should be incorporated into the second plate to prevent the magnet from falling through the aperture, and off of the device.

The second plate contains at least one means for attaching the first plate to the second plate through the thin pliable material. In a highly preferred embodiment these means for attaching the first plate to the second plate include at least one male protrusion which extends from the lower surface of the first plate. The male protrusion is designed to fit in an aperture in the upper portion of the second plate, the aperture defining a female portion in the upper surface of the second plate.

The male portion on the first plate is designed for insertion through a fabric or other pliable material. This allows easy installation of the magnetic support system at any location on a section of fabric, such as a kitchen towel, curtain or the like.

According to another aspect of the instant invention the first plate and the second plate are connected to one another by a section of resilient material. This arrangement allows the user to single attach the two plates to a section of fabric or the like with a single hand.

Another important feature of a highly preferred embodiment of the invention includes a protruding perimetral wall about the perimeter of the lower surface of the first plate. Additionally, the upper surface of the second plate will include at least one raised portion of a thickness that is less than the thickness of the magnet. By having a raised section on the upper surface of the second plate, and the raised section being of a height that is less than the thickness of the magnet, one produces a system that, when assembled, forces a portion of the magnet into the aperture in the lower surface of the first plate. This in turn will force the fabric, or other pliable material to which the invention is being attached, into the aperture in the lower surface of the first plate, pinching the fabric or pliable material against the first plate.

Thus it will be understood that the instant invention produces new and useful results in that it may be attached to any pliable material, including sections of somewhat stiff materials such as cardboard, without requiring the incorporation of special pockets or the like.

Still further, the instant invention produces new and useful results in that it produces new levels of convenience to the user by eliminating the need to examine the orientation or face of the towel or section of fabric to determine which side is the effective side of the magnet.

Still another new useful result achieved by the structure of the instant invention is the provision of a secure attachment which minimizes the amount of material between the magnet and the surface from which the fabric is to be supported.

Still yet another new useful result achieved with the embodiments of the instant invention is a system that allows effective radiation of the magnetic field from both sides of the support.

Still further, an important new and useful result that is achieved with the instant invention is the ability to hang items such as kitchen towels, dish rags, sections of fabric or the like from ferrous surfaces without having to consider the side from which the towel or rag is being hung or from where on the surface the towel or rag is being hung.

Still further, the instant invention allows the user to place or hang the dish towel or other section of material anywhere on a ferrous or magnetic surface, without having to reach for a position where a hook or other hanging device is located.

It is an important advantage of the instant invention that the once the magnetic support system has been attached to a section of fabric, such as is found on a kitchen towel, dish rag, or the like, one does not have to remove the magnetic support attachment in order to launder the fabric.

Still further, it will be understood that the instant invention may also be attached to items such as a loop found on a pot holder in order to hang the pot holder from a refrigerator, stove, or other appliance or surface which includes ferrous materials.

It should also be understood that while the above and other advantages and new, useful results of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
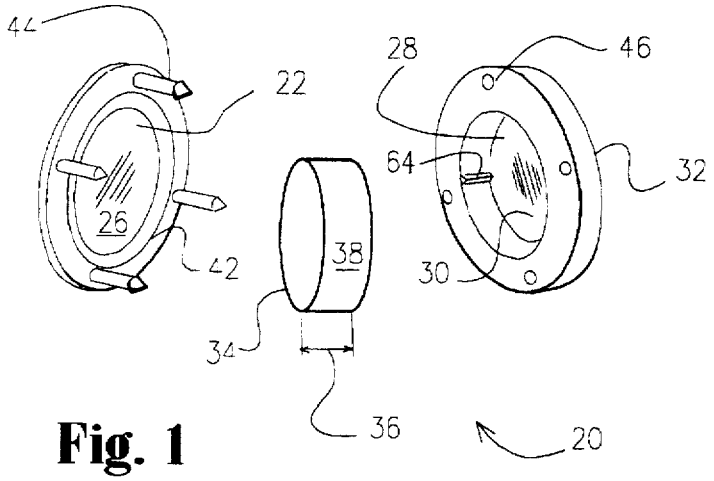
FIG. 1 is an exploded, perspective view showing the components of a highly preferred embodiment of the invention.

Turning now to FIG. 1 where a support system 20 for magnetically supporting a thin, pliable section of material has been illustrated. As illustrated, the support system 20 includes a first plate 22 having an upper surface 24 and a lower surface 26. Mating with the first plate 22 is a second plate 28 having an upper surface 30 and a lower surface 32. Between the first plate 22 and the second plate 28 is a magnet 34 having a thickness 36 and a perimeter 38.

Also illustrated on FIG. 1 are means for attaching the first plate 22 to the second plate 28, so that the magnet 34 may be trapped and secured between the first plate 22 and the second plate 28 by means of at least one rib 64. In the illustrated embodiment of the invention these means for attaching the first plate to the second plate 28 include a protrusion defining a male portion 44. The male portion 44 cooperates with an aperture defining a female portion 46 which is used with the second plate 28. The details of the male portion 44 and the female portion 46 will be discussed in greater detail below.

Figure 2:
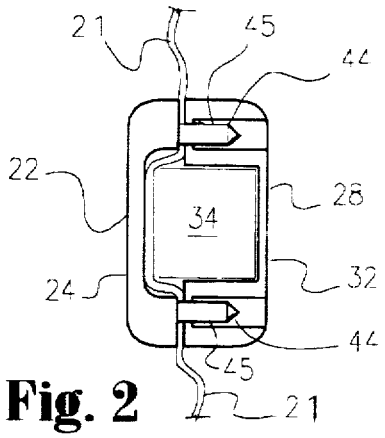
FIG. 2 is a side sectional view illustrating the use of the instant invention on a section of fabric such as a section from a kitchen towel.

In FIG. 2 it has been illustrated that the instant invention is particularly well suited for mounting on a thin, pliable section of material 21, such as section of fabric found in a kitchen towel, a handkerchief, shop towel, draping material and the like. Importantly, FIG. 2 illustrates that in a highly preferred embodiment of the support system 20, the first plate 22 includes an aperture 42 which is slightly larger than the perimeter 38 of the magnet 34. By incorporating an aperture 42 that is slightly larger than the perimeter 38 of the magnet 34 one can achieve a pinching or gripping of the material 21 between the magnet 34 and the aperture 42 in the first plate 22.

Also shown on FIG. 2 is that lower surface 26 of the first plate 22 will preferably include means for attaching the first plate 22 to the second plate 28. These means for attaching the first plate to the second plate may take form as one of many known mechanical fasteners which can be used to secure two plates through a thin section of material. However, in a highly preferred embodiment of the invention these means include at least one protrusion defining a male portion 44 having a body 45, the male portion 44 extending from the lower surface 26 of the first plate 22. Cooperating with the protrusion 44 is at least one aperture defining a female 46 portion in the upper surface 30 of the second plate 28.

Figure 4A:
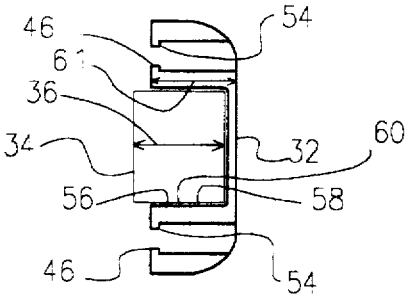
FIG. 4A is a side sectional view showing the second plate used with a highly preferred embodiment of the instant invention.
Figure 4C:
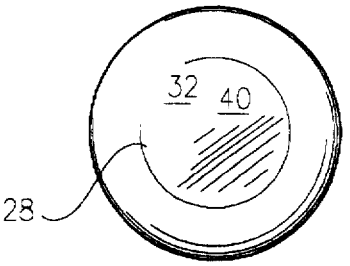
FIG. 4C is a plan view looking at the lower surface of the second plate used with the instant invention.
Figure 4B:
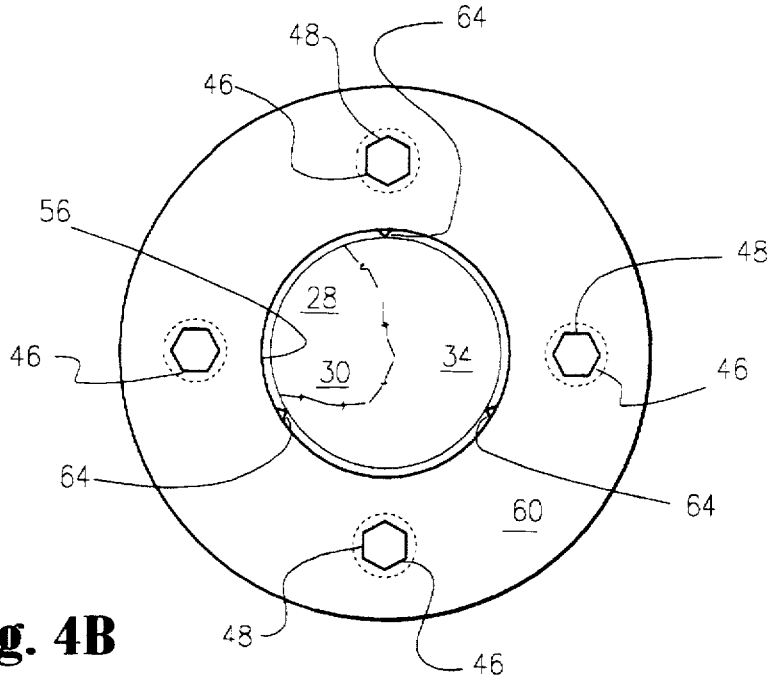
FIG. 4B is a plan view looking at the upper surface of the second plate of a preferred embodiment of the instant invention.

Referring now to FIGS. 4A, 4B, 4C, 5 and 6 it can be understood that the female portion 46, as shown on FIG. 4B, of the preferred embodiment is not round, but includes flat sides 48 that define a generally hexagonal shape. Moreover, as shown on FIGS. 5 and 6, some of the male portions 44 include at least one barb 50 and a point 52. The points 52 on the male portions help the male portion 44 to pierce through the material on which the invention is to be attached. The barbs 50 are designed to mate with the flat sides 48 of the female portion 46. It should be noted that while the preferred embodiment includes a female portion 46 with flat sides arranged in a generally hexagonal shape, it is contemplated that the flat sides of the female portion 46 may be arranged in one of many shapes. This includes triangles, rectangles, octagons, and so on, so long as the shape of the female portion permits deformation of the female portion or the male portion in order to produce an interference type fit which results in a strong grip of the male portion by the female portion. Also, it is advantageous to place several female portions 46 in a symmetrical pattern over the upper surface 30 of the second plate 28 or over the raised portion 58. This symmetrical arrangement allows attachment of at least one male portion 44 to a female portion 46 without having to verify the position of the first plate 22 relative to the second plate 28. In other words, the symmetrical arrangement allows the user to place at least one male portion 44 over a female portion 46, allowing the male portion 44 to engage the female portion 46 when the first plate 22 is in one of several positions relative to the second plate 28. Thus a preferred embodiment of the invention will include a symmetrical pattern of attachment means such as the male elements and the female elements. This adds convenience to the user, in that the user may easily align the male portions 44 with the female portions 46 in one of many different positions relative to one another.

Figure 5:
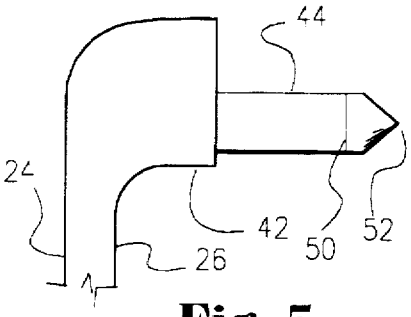
FIG. 5 is a detailed side sectional view of a male portion on the lower surface of a highly preferred embodiment of the first plate.
Figure 5A:
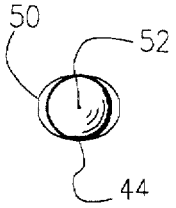
FIG. 5A is an end view of the male portion shown on FIG. 5.

As shown on FIGS. 5 and 5A, the barbs 50 cooperate with at least one ridge 54 in the female portion 46. It is important to note that, in the preferred embodiment, the body 45 of male portion 44 is designed to provide an interference type fit within the female portion 46. Thus, the ridge 54 and generally hexagonal shape of the female portion 46 allow an the male portion 44 as well as the female portion 46 to deform by providing areas where the upset material may move. Thus, in the female portion 46 the material from the male portion 44 will deform into the corners 56 at the ends of the flat sides 48 of the female portion 48. Similarly, the ridge 54 provides space that accepts the upset material from the female portion 46 once the male portion 44 has been inserted.

As shown on FIG. 4B, the second plate 28 will preferably include four equally spaced female portions 46 on its upper surface 30. The arrangement of the flat sides 48 of the female portions 46 have been positioned such that upon the insertion of the male portions 44 into the female portion 46, the barbs 50 will always mate with one of the flat sides 48 of the female portion 46.

Figure 3A:
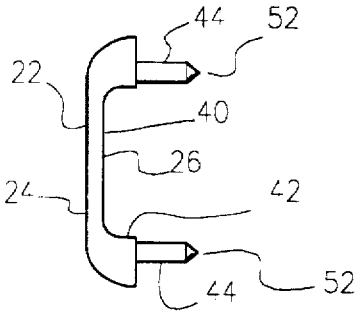
FIG. 3A is a side sectional view showing the first plate used with a highly preferred embodiment of the instant invention.
Figure 3B:
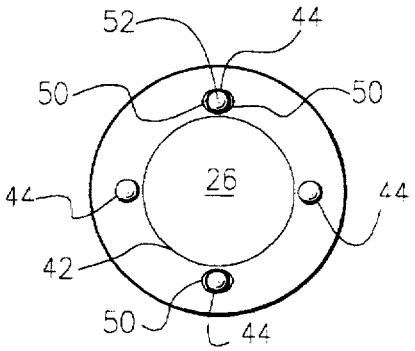
FIG. 3B is a plan view looking at the lower surface of the first plate of a preferred embodiment of the instant invention.
Figure 6:
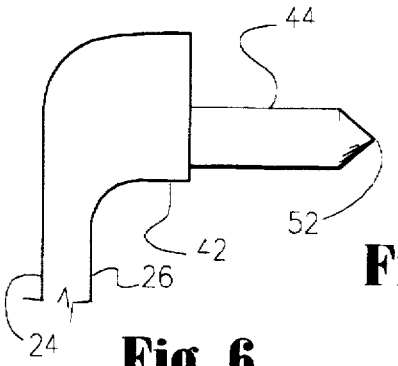
FIG. 6 is a detailed side sectional view of a male portion on the lower surface of a highly preferred embodiment of the first plate.
Figure 6A:
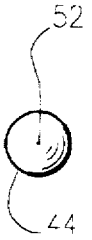
FIG. 6A is an end view of the male portion shown on FIG. 6.

It is important to note that, as shown on FIGS. 3B, 5 and 6, some of the male portions 44 will preferably include the barbs 50, while other male portions 44 will not include barbs 50. The barbless male potions 44 serve to provide stability and an effective grip of the material through which the male portions have been inserted. The male portions 44 with barbs 50 also provide a secure grip of the second plate 28.

Also shown as part of the preferred embodiment is that the second plate 28 includes a means for accepting the magnet 34, which in a preferred embodiment includes a pocket 56 or aperture. The pocket 56 is defined by at least one raised portion 58 that extends from the upper surface 30 of the second plate 28. In a highly preferred embodiment shown on FIG. 4A, the raised portion 58 defines a wall 60. As shown on FIG. 4A the raised portion 58 will protrude a distance 61 from the plate. The distance 61 should be smaller than the thickness 36 of the magnet 34. With this arrangement the magnet 34 will be forced into the aperture 42 in the first plate 22 when the first plate 22 and the second plate 28 are joined as shown on FIG. 2.

Figure 3C:
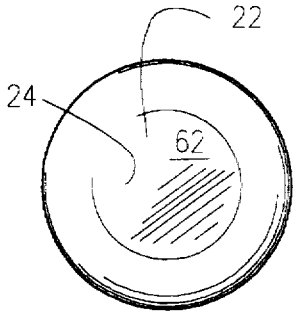
FIG. 3C is a plan view looking at the upper surface of the first plate used with the instant invention.

Turning now to FIG. 3C, where it has been illustrated that the upper surface 24 of the first plate 22 includes a flat surface 62. The flat surface 62 has been incorporated into an area of the first plate 22 which will lie over the magnet 34 when the first plate 22 and the second plate 28 are joined as shown on FIG. 2. It is contemplated that the support system 20 will be molded from any relatively stiff plastic that provides a good coefficient of friction. It has been found that materials such as polypropylene, and in particular low density polyethylenes provide a good combination of stiffness and frictional properties. Thus by placing this flat surface 62 over the magnet 34 one ensures that the magnetic pull of the magnet 34 will be exerted directly over the flat surface 62; which in turn ensures that the normal force by the magnet forces the flat surface 62 against the support surface and allows the device to take advantage of the coefficient of friction of the plastic material.

An important synergistic effect has been discovered, and which will be clearly understood by referring once again to FIG. 2. A synergistic result has been found in that by using a relatively stiff and thin first plate 28, made from a relatively rubbery material, one allows adequate compression of the thin section of material 40 between the magnet 34 and the lower surface 26 of the first plate 22. By compressing the section of material 40 against the lower surface 26 of the first plate 22 one minimizes the distance between the magnet 34 and the support surface. This, in turn, minimizes the attenuation of the magnetic field between the magnet 34 and the ferrous support surface, in order to ensure proper support from the support surface.

It is also important to note that the material of the plates should be somewhat rigid rather very elastic. It has been found that while highly elastic materials may provide high coefficients of friction, these highly elastic materials will deform over the magnet and reduce the amount of shear force that can be developed between the upper surface 24 and the support surface. This reduction in the amount of shear force that can be developed is due to the development of a curvature in the first plate 24 when the first plate 24 is forced over the magnet 34. The presence of a curve will prevent the development of the full capacity of the friction force needed to keep the device from sliding over the support surface when supporting a wet or soiled dish towel, for example.

Similarly, the second plate 28 should be made of a high friction coefficient material with enough rigidity to resist deformation, so that the lower surface 32 of the second plate 28 remains flat. Thus it is contemplated that the material of the preferred embodiment of the second plate 28 should be a relatively rigid, but rubbery plastic composition such as low density polyethylenes. However, it should also be noted that as shown on FIG. 4A, the second plate used with a highly preferred embodiment of the instant invention uses the raised portion 58 to add stiffness to the second plate 28 in order to ensure that the lower surface 32 of the second plate 28 remains flat.

Figure 7:
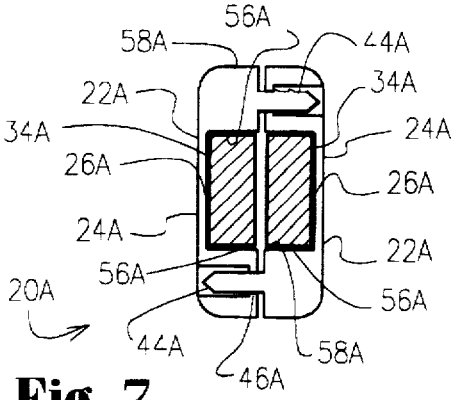
FIG. 7 is a side sectional view of a variation of embodiments including structure taught herein.

Referring now to FIG. 7, where a side sectional view of a variation of embodiments including structure taught herein has been shown. The embodiment of the support system 20A shown on FIG. 7 includes a pair of a first plates 22A. The first plate 22A includes an upper surface 24A and a lower surface 26A. On the lower surface 26A is a raised portion 58A, at least one male portion 44A, and at least one female portion 46A. Even quantities of male portion 44A and female portions 46A should be place on the raised portion 58A so as to divide the raised portion 58A into equal, symmetrical areas. This symmetry will allow the molding of a single piece that may be used in pairs that cooperate with one another to carry out the functions of both the first plate 22 of the preferred embodiment and of the second plate 28 of the preferred embodiment of the invention 20.

Thus, as shown on FIG. 7, a single magnet may be held by a pair of first plates 22A. However, the use of a pair of first plates 22A would require that the magnets be held in pockets 56A formed by the raised portion 58A and the lower surface 26A of the first plate 22A. As shown on FIG. 4B, the magnets may be held in place by at least one rib 64 in the pockets 56A. The rib 64 will allow attachment of the magnet without glues or similar adhesives.

The embodiment shown on FIG. 7 offers the advantage of allowing the production of a working support system that may be used to hang sections of fabric and the like from ferrous surfaces with a pair of a single plate. This offers advantages in that it would reduce the molds required to produce a working system, and may reduce the number of parts inventoried for assembling the system. However, it has been discovered that the embodiment shown on FIG. 7 may require that the polarity of the magnets be ascertained and the magnets 34A inserted into the pockets 56A so that the magnets on opposite sides of the fabric will draw one another instead of repelling each other. This adds steps to assembly, but offers the advantage of resulting in an assembly with increased magnetic strength.

Figure 8:
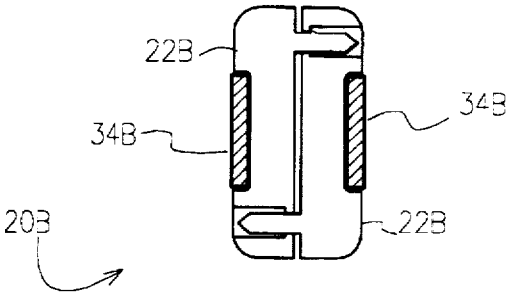
FIG. 8 is a side sectional view of yet another variation of embodiments including structure taught herein.

Turning now to yet another variation of the instant invention 20B which has been shown on FIG. 8, it will be appreciated that the magnets may be placed in pockets 56B that have been formed over a first plate 22B. While the embodiment shown in FIG. 8 will exhibit many of the advantages of the preferred embodiment, the embodiment is not the preferred embodiment due to the fact that it will present exposed magnet surfaces to the support surface. By exposing the magnet surface to the support surface one runs the risk of scratching or damaging the support surface. Clearly one could minimize the problem of damaging the support surface by including flexible magnets 34B such as flexible rubber magnetic strips, instead of hard metal magnet arrangements. However, it has been found that the use of flexible rubber magnetic strips would require the use of relatively large sections of flexible magnetic strips, in the range of one inch or more in diameter, to obtain the needed force to sustain a wet dish towel, for example. Moreover, the use of magnets on the surface of the plates may introduce the problem of separation of the magnets from the plates during laundering of the rag or towel on which the device has been mounted.

Figure 9A:
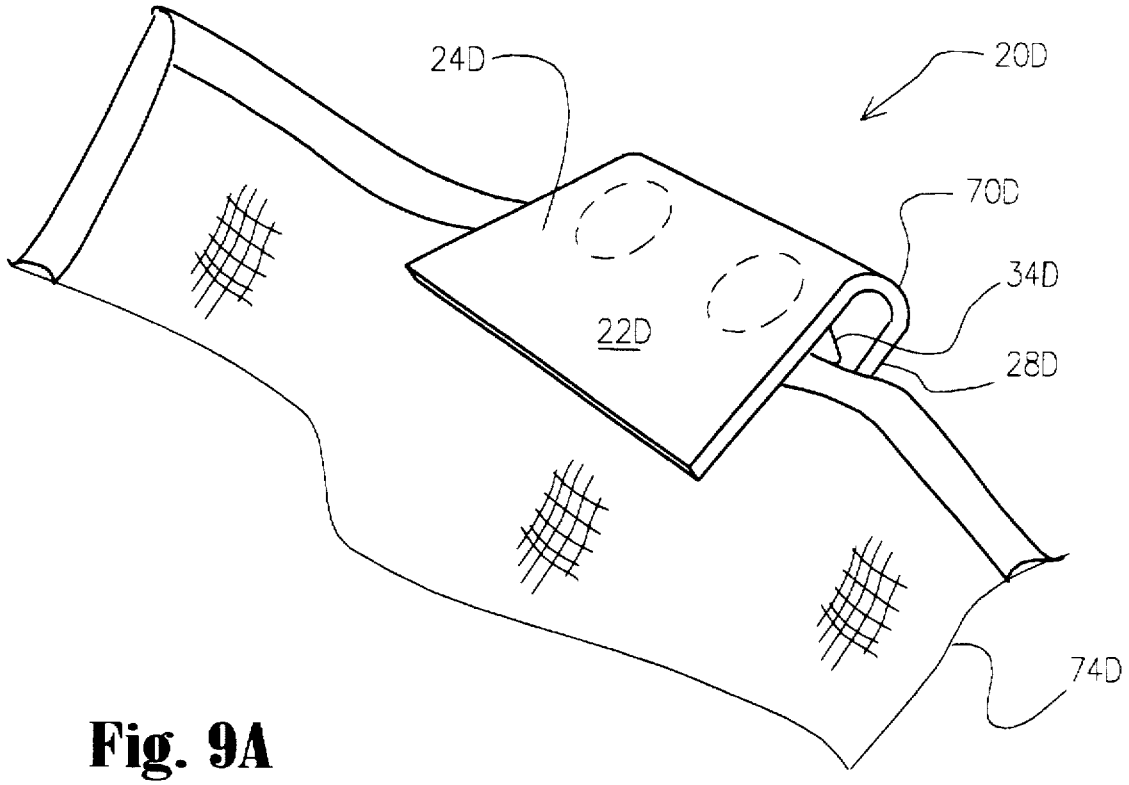
FIG. 9A is a perspective view of yet another variation of a magnetic kitchen towel support made according to principles taught herein.
Figure 9B:
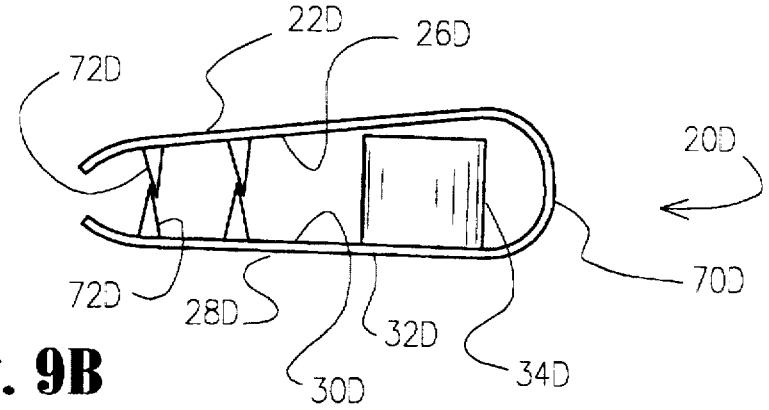
FIG. 9B is a side view of the embodiment shown on FIG. 9A.

Shown on FIGS. 9A and 9B is yet another variation of a magnetic kitchen towel support 20D made according to principles taught herein. In the embodiment shown in FIGS. 9A and 9B a first plate 22D is connected to a second plate 28D by a resilient connector 70D. The first plate 22D has an upper surface 24D and a lower surface 26D. Similarly, the second plate 28D includes an upper surface 30D and a lower surface 32D. Between the lower surface 26D of the first plate 22D and the upper surface 30D of the second plate 28D is attached at least one magnet 34D. The magnet 34D may be attached to either the lower surface 26D of the first plate 22D and the upper surface 30D of the second plate 28D and placed near the resilient connector 70D. Additionally, means for gripping a piece of fabric are also included on the lower surface 26D of the first plate 22D and the upper surface 30D of the second plate 28D. In a preferred embodiment these means for gripping a piece of fabric include a set of teeth 72D. Thus it will be appreciated that with this arrangement a kitchen towel support 20D may be fabricated from a single sheet of resilient plastic material. Moreover, the kitchen towel support 20D may be used to grip a section of material from a kitchen towel 74D or the like, and then used to hang the section of material form a ferrous surface to suspend the material by means of the magnet 34D.

Figure 10:
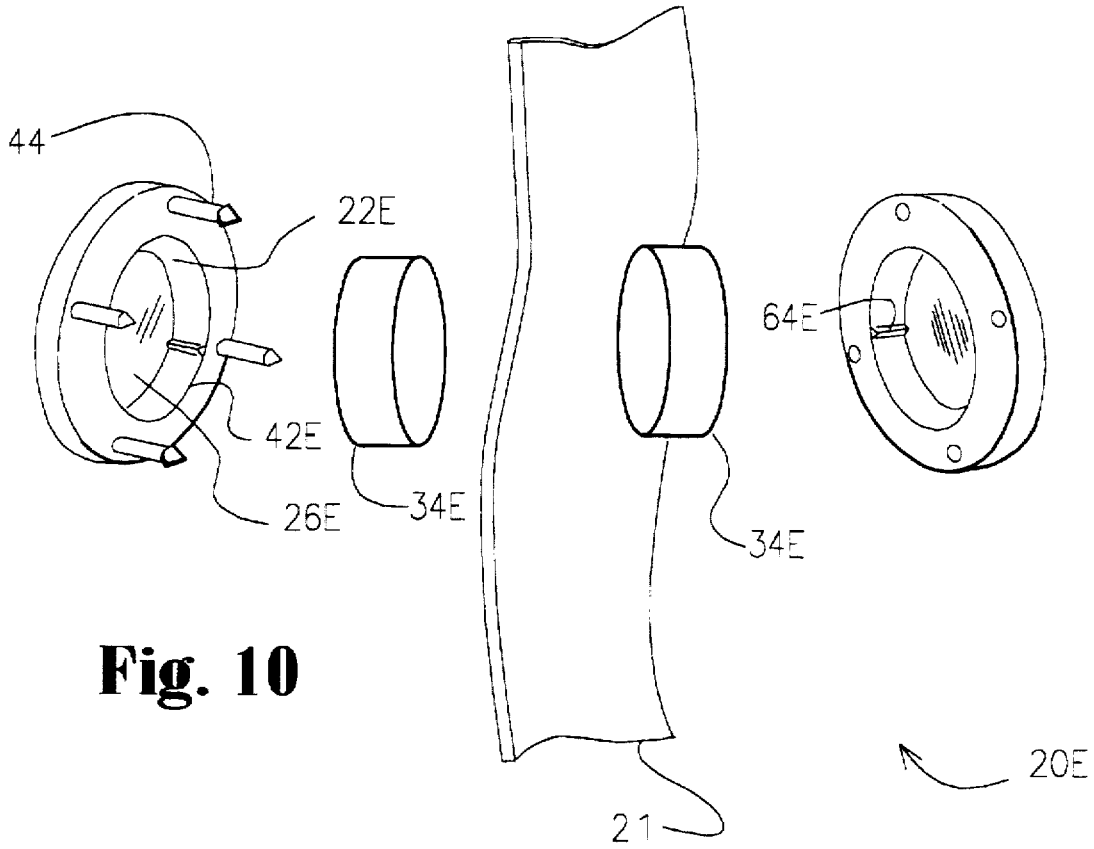
FIG. 10 is a perspective view of a preferred embodiment of a magnetic kitchen towel support made according to principles taught herein.
Figure 11:
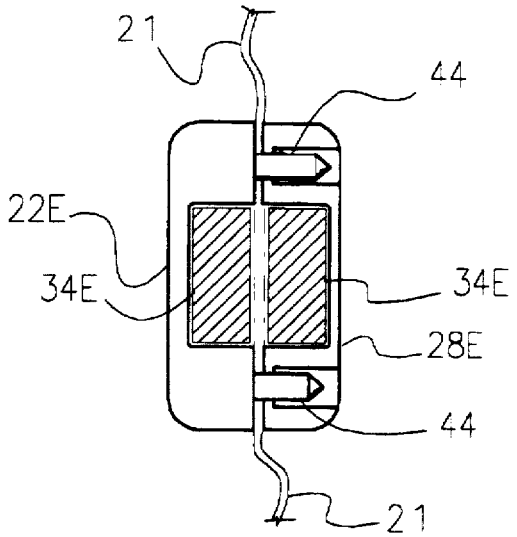
FIG. 11 is a side view of the embodiment shown on FIG. 10.

Turning now to FIGS. 10 and 11 where an embodiment of the invention has been referred to as 20E. The embodiment 20E having a pair of magnets 34E; each magnet 34E having a thickness 36E and perimeter 38E. The embodiment 20E also includes a first plate 22E with a lower surface 26E and an aperture 42E. From the lower surface 26E of the first plate 22E extends a raised portion 58E. The raised portion 58E includes means for retaining the magnet 34E as well as male portions 44E. In a preferred embodiment of the invention 20E the means for retaining the magnet 34E include at least one rib 64E. Since the first plate 22E incorporates at least one male portion 44E, it is contemplated that the first plate 22E may be used with a second plate 28E. However, it should be noted that magnets 34E used with the embodiment 20E are designed to rest on both sides of the pliable material 21. These magnets may be sized so as to compress the pliable material 21 between the magnets. It should be noted that with this embodiment the magnets 34E will reinforce one another, producing a high strength pull towards the mounting surface.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A support system for magnetically supporting a thin pliable section of fabric material, the support system comprising:

a magnet;

a first plate having an upper surface and a lower surface, the lower surface having a first recess and supporting at least two male portions, the male portions being adapted for attachment through the thin pliable section of fabric material;

a second plate having an upper surface and a lower surface, the upper surface of said second plate having a second recess adapted for receiving said magnet and at least two means for accepting the male portions, the means for accepting the male portions being spaced apart and next to generally and generally straddling the recess adapted for receiving said magnet, so that said thin pliable fabric material is retained between the lower surface of said first plate and said upper surface of said second plate when said male portions are inserted through the thin pliable fabric material and into the means for accepting the male portions included in the second plate, said means for accepting the male portions of said first plate having at least two apertures, each defining a female section;

said first and second recesses having diameters larger that the diameter of the magnet;

whereby said first and second recesses are adapted to cooperate and retain the magnet and capture the thin pliable fabric material between the first recess and the magnet.

2. The support system according to claim 1 wherein said first plate and said second plate are connected by a resilient section of material.

3. The support system according to claim 2, wherein said resilient section of material is integral with said first plate and said second plate.

4. A support attachment for magnetically supporting a thin pliable section of fabric material, the support attachment comprising:

at least one magnet having a perimeter and a thickness;

a first plate having an upper surface and a lower surface, the lower surface having at least two male portions extending from said lower surface and a first aperture, said first aperture being adapted for accepting the perimeter of said magnet;

a second plate having an upper surface, a lower surface, and a second aperture being adapted for accepting the perimeter of said magnet, the upper surface of said second plate having at least one raised portion of a thickness, the thickness of the raised portion on the upper surface of the second plate being less than the thickness of the magnet, the raised portion of said second plate further having means for accepting the male portion of said first plate;

so that when said male portion is accepted by the means for accepting said male portion, said thin pliable fabric material is retained between the upper surface of said first plate and said at least one magnet, said at least one magnet being retained between said first plate and said second plate by the acceptance of the male portions within said means for accepting the portions of said second plate, so that pliable section of fabric material is retained against said magnet by said first plate and said second plate, and so that the pliable section of fabric material may be magnetically supported from a surface including ferrous material said means for accepting the male portions of said first plate having at least two holes, each defining a female section;

said first and second apertures having diameters larger that the diameter of the magnet;

whereby said first and second apertures are adapted to cooperate and retain the magnet and capture the thin pliable fabric material between the first aperture and the magnet.

5. The support attachment according to claim 4 and wherein said at least one magnet comprises a pair of magnets, one magnet being mountable on the first plate and one magnet being mountable on the second plate.

6. The support attachment according to claim 4 wherein said first and second apertures include at least one projecting rib.

7. The support attachment according to claim 4 wherein the male portions contain at least one barb.

8. A support attachment for magnetically supporting a piece of fabric from a ferrous surface, the support attachment comprising:

a first plate having a first recess and a generally flat upper surface and a lower surface;

at least two male portions extending from the lower surface of the first plate, the male portions being adapted for extending through the piece of fabric;

a second plate having an upper surface and a lower surface, the upper surface of the second plate having a second recess for retaining a magnet, the upper surface of the second plate further having means for accepting the male portions extending from the first plate and straddling said second recess for retaining a magnet, so that a magnet may be retained against the fabric between said first plate and said second plate when said male portions are accepted by the means for accepting the male portions in said second plate as the male portions extend through the section of fabric;

said means for accepting the male portions of said first plate having at least two holes, each defining a female section;

said first and second recesses having diameters larger that the diameter of the magnet;

whereby said first and second recesses are adapted to cooperate and retain the magnet and capture the thin pliable fabric material between the first aperture and the magnet.

9. The support attachment according to claim 8 wherein said second recess for retaining said magnet comprises at least one projecting rib.

10. The support attachment according to claim 8 wherein said male portions further comprise at least one barb.

11. The support attachment according to claim 8 wherein the upper surface of said second plate further comprises at least two male portion adapted for extending through the section of fabric; and the lower surface of said first plate further comprises at least two apertures adapted for engaging the male portion on said lower surface of said second plate.

* * * * *